US010309194B2

(12) United States Patent
Haake et al.

(10) Patent No.: US 10,309,194 B2
(45) Date of Patent: Jun. 4, 2019

(54) DOWNHOLE FLUID VALVE

(71) Applicant: Halliburton Energy Services Inc., Houston, TX (US)

(72) Inventors: Russell Stephen Haake, Dallas, TX (US); Scott Luke Miller, Highland Village, TX (US); Paul Ringgenberg, Frisco, TX (US); Vince Zeller, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 319 days.

(21) Appl. No.: 15/303,775

(22) PCT Filed: May 15, 2014

(86) PCT No.: PCT/US2014/038129

§ 371 (c)(1),
(2) Date: Oct. 13, 2016

(87) PCT Pub. No.: WO2015/174980

PCT Pub. Date: Nov. 19, 2015

(65) Prior Publication Data

US 2017/0051573 A1 Feb. 23, 2017

(51) Int. Cl.
*E21B 34/08* (2006.01)
*E21B 33/12* (2006.01)

(52) U.S. Cl.
CPC ..... *E21B 34/08* (2013.01); *E21B 33/12* (2013.01)

(58) Field of Classification Search
CPC .. E21B 34/14; E21B 2034/007; E21B 21/103; E21B 33/12; E21B 34/06; E21B 34/08; E21B 34/10; E21B 34/103
See application file for complete search history.

(56) References Cited

U.S. PATENT DOCUMENTS 3,824,850 A * 7/1974 Nutter ..... E21B 34/10 73/152.23
4,846,272 A 7/1989 Leggett
5,240,072 A * 8/1993 Schultz ..... E21B 23/006 166/169
6,681,852 B2 1/2004 Baskett et al.
7,467,675 B2 12/2008 Lay
2005/0178558 A1 8/2005 Kolle et al.
(Continued)

FOREIGN PATENT DOCUMENTS

WO 2015174980 A1 11/2015

*Primary Examiner* — Daniel P Stephenson
(74) *Attorney, Agent, or Firm* — John Wustenberg; Parker Justiss, P.C.

(57) ABSTRACT

A downhole distributor valve includes a housing that includes a housing fluid port therethrough, a mandrel that defines a bore and is positioned radially within the housing, and a fluid chamber radially defined between the housing and the mandrel and configured to contain a fluid at a particular pressure. The mandrel includes a mandrel fluid port therethrough. The mandrel is moveable from a first position with the bore fluidly decoupled from the housing fluid port to a second position with the bore fluidly coupled with the housing fluid port through the mandrel fluid port. The mandrel is moveable based on a hydrostatic pressure in the bore greater than the particular pressure of the pressurized fluid.

17 Claims, 5 Drawing Sheets

(56) References Cited

U.S. PATENT DOCUMENTS

| | | | | |
|---|---|---|---|---|
| 2013/0292133 | A1 | 11/2013 | Thompson | |
| 2016/0084039 | A1* | 3/2016 | Harris | E21B 34/101 137/12 |
| 2017/0051573 | A1* | 2/2017 | Haake | E21B 34/08 |

* cited by examiner

DOWNHOLE FLUID VALVE

CROSS-REFERENCE TO RELATED APPLICATION

This application is the National Stage of, and therefore claims the benefit of, International Application No. PCT/US2014/038129 filed on May 15, 2014, entitled "DOWNHOLE FLUID VALVE," which was published in English under International Publication Number WO 2015/174980 on Nov. 19, 2015. The above application is commonly assigned with this National Stage application and is incorporated herein by reference in its entirety.

TECHNICAL BACKGROUND

This disclosure relates to a downhole fluid valve, for example, a distributor valve.

BACKGROUND

Prior to performing a drill stem test, packers can be used to isolate sections of the annulus between the wellbore and the testing string. When a packer is used, a pressure differential can exist between the uphole and downhole sides of the packer. A high pressure differential can stress the surrounding formation to the point of damaging the formation. A high pressure differential can also cause a wellbore fluid (e.g., drilling fluid or "mud" or otherwise) to flow around the packer though fractures. The pressure differential can be mitigated by distributing the pressure across multiple packers.

DETAILED DESCRIPTION

Figure 1:
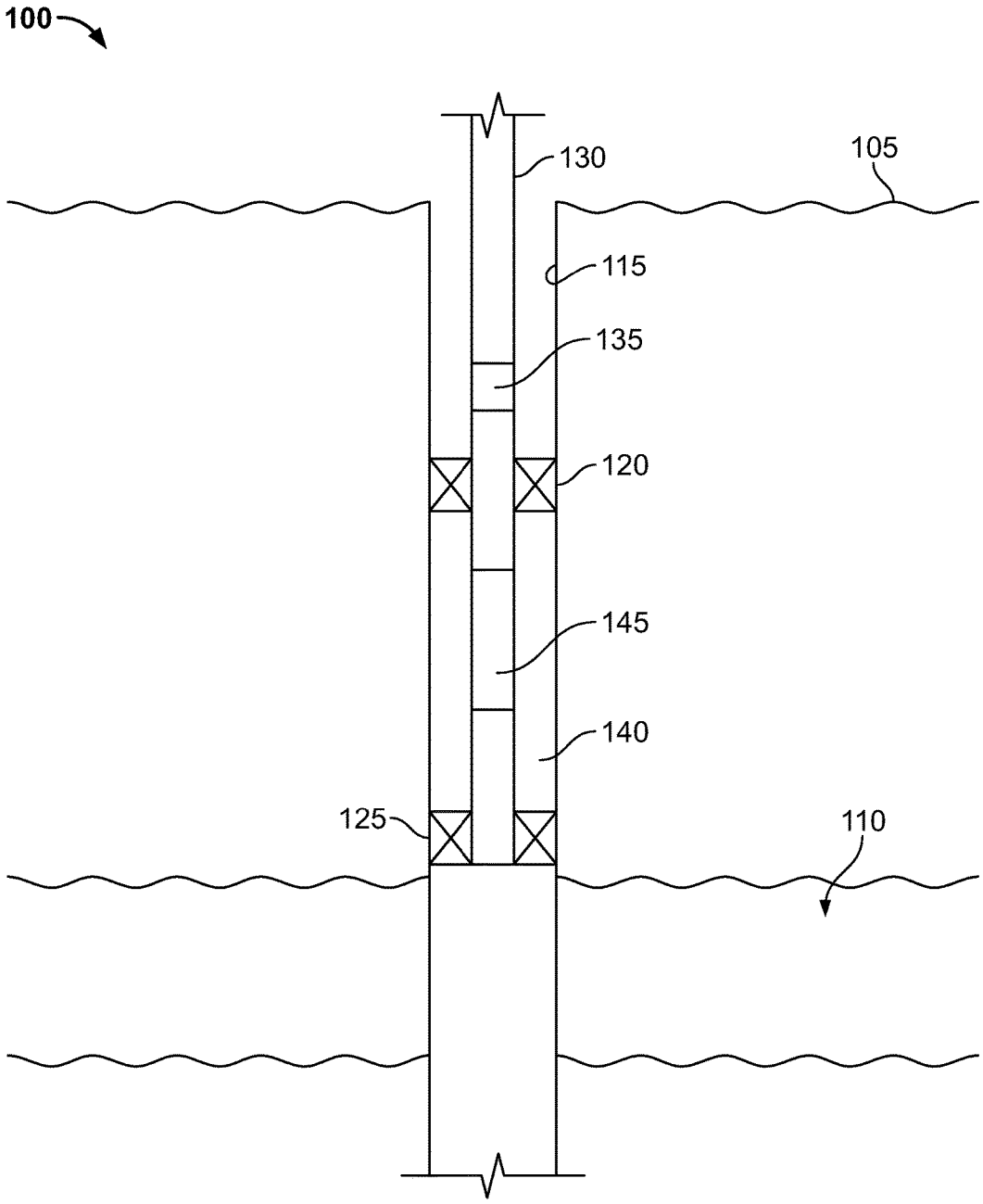
FIG. 1 illustrates an example well system that includes a downhole fluid valve, such as a distributor valve.

The present disclosure relates to a downhole fluid valve in a wellbore. The fluid valve is able to regulate the pressure in an isolated section of an annulus, e.g., fluidly isolated between two or more seals (e.g., packers). The fluid valve uses a fluid chamber as a reference to maintain the annulus pressure at a desired pressure. The pressure of the fluid in the fluid chamber can be determined prior to insertion of the valve into the wellbore, and as such the desired annulus pressure can be determined prior to insertion. When wellbore hydrostatic pressure at the fluid valve's location is greater than the pressure of a pressurized fluid (e.g., a gas such as nitrogen) in the fluid chamber, the fluid valve opens a conduit between the tubing and the annulus. When fluid flows through the wellbore (e.g., production) by, for instance, opening another flow device (e.g., tester valve) uphole of the fluid valve is established, the tubing pressure decreases. The open fluid valve allows annulus fluid to escape into the tubing, reducing the pressure in the annulus.

When the tubing pressure at the fluid valve is less than the pressure in the fluid chamber, the fluid valve closes, isolates the annulus from the tubing, and establishes a desired pressure in the annulus.

In one general implementation, a downhole distributor valve includes a housing that includes a housing fluid port therethrough, a mandrel that defines a bore and is positioned radially within the housing, the mandrel including a mandrel fluid port therethrough, and a fluid chamber radially defined between the housing and the mandrel and configured to contain a fluid at a particular pressure, the mandrel moveable from a first position with the bore fluidly decoupled from the housing fluid port to a second position with the bore fluidly coupled with the housing fluid port through the mandrel fluid port based on a hydrostatic pressure in the bore greater than the particular pressure of the pressurized fluid.

In a first aspect combinable with the general implementation, the fluid chamber includes a gas chamber, and the fluid at the particular pressure includes a gas at the particular pressure.

In a second aspect combinable with any of the previous aspects, the gas includes nitrogen.

A third aspect combinable with any of the previous aspects further includes a fluid fill port at the exterior surface of the housing that is fluidly coupled to the fluid chamber.

In a fourth aspect combinable with any of the previous aspects, the mandrel is moveable from the second position with the bore fluidly coupled with the housing fluid port through the mandrel fluid port to the first position with the bore fluidly decoupled from the housing fluid port based on the hydrostatic pressure in the bore less than the particular pressure of the fluid in the fluid chamber.

In a fifth aspect combinable with any of the previous aspects, the particular pressure is based, at least in part, on a difference in an estimated downhole temperature and an estimated surface temperature.

In a sixth aspect combinable with any of the previous aspects, the mandrel includes a radial outer surface between an upper seal positioned between the mandrel and the housing and a lower seal positioned between the mandrel and the housing, the radial surface including an effective force area between the pressurized fluid and the hydrostatic pressure.

In another general implementation, a method includes moving a distributor valve at a closed position into a wellbore, the distributor valve including a housing that comprises a housing fluid port, a mandrel that defines a bore and is positioned radially within the housing, and a fluid chamber radially defined between the housing and the mandrel, moving the distributor valve toward a downhole location in the wellbore at the closed position, the bore fluidly decoupled from the housing fluid port at the closed position, and based on a hydrostatic pressure in the bore that is greater than a particular pressure of a fluid contained in the fluid chamber, adjusting the distributor valve to an open position by urging the mandrel, with the hydrostatic pressure, to fluidly couple the bore to the annulus through a mandrel fluid port and the housing fluid port.

A first aspect combinable with the general implementation further includes including charging the fluid chamber with an amount of the fluid to the particular pressure prior to moving the distributor valve into the wellbore.

A second aspect combinable with any of the previous aspects further includes determining the particular pressure based at least in part on a difference in an estimated temperature in the wellbore at the downhole location and an estimated surface temperature.

In a third aspect combinable with any of the previous aspects, the gas includes nitrogen.

In a fourth aspect combinable with any of the previous aspects, the downhole location in the wellbore is uphole of a first seal that fluidly decouples a portion of the annulus downhole of the first seal from a portion of the annulus uphole of the first seal, the method further including locating a second seal uphole of the downhole location and setting the second seal to fluidly decouple a portion of the annulus uphole of the second seal from a portion of the annulus between the first and second seals.

A fifth aspect combinable with any of the previous aspects further includes adjusting the distributor valve to the open position based on setting the second seal.

A sixth aspect combinable with any of the previous aspects further includes opening a tester valve in fluid communication with the distributor valve in a downhole work string, the tester valve positioned uphole of the distributor valve in the downhole work string and flowing a wellbore fluid through the bore and toward a terranean surface based on opening the tester valve.

A seventh aspect combinable with any of the previous aspects further includes based on opening the tester valve, adjusting the distributor valve to the closed position by urging the mandrel, with the pressurized fluid contained in the fluid chamber, to fluidly decouple the bore from the annulus.

An eighth aspect combinable with any of the previous aspects further includes misaligning the mandrel fluid port and the housing fluid port to fluidly decouple the bore from the annulus.

In another general implementation, a downhole valve includes an outer case that includes a flow path port therethrough, a mandrel that defines a bore and is positioned radially within the case, the mandrel including a fluid port therethrough, and a pressurized gas chamber that encloses an amount of gas at a predetermined pressure, the pressurized gas chamber defined between the outer case and the mandrel, the mandrel moveable from a closed position with the bore fluidly decoupled from the flow path to an open position with the bore fluidly coupled with the flow path through the fluid port based on a hydrostatic pressure in the bore greater than the predetermined pressure of the gas.

In a first aspect combinable with the general implementation, the mandrel is moveable from the open position with the bore fluidly coupled with the flow path through the fluid port to the closed position with the bore fluidly decoupled from the flow path based on the hydrostatic pressure in the bore less than the predetermined pressure of the gas.

In a second aspect combinable with any of the previous aspects, the pressurized gas chamber includes a self-contained chamber that is fluidly decoupled from the exterior during operation of the valve.

In a third aspect combinable with any of the previous aspects, the predetermined pressure is determined based, at least in part, on at least one of a downhole temperature or a characteristic of a subterranean zone.

Various implementations of a downhole fluid valve according to the present disclosure may include none, one or some of the following features. The fluid valve is a self-contained system that is comparatively easy to adjust and maintain. For example, the pressure of the fluid in the fluid chamber can be set accurately through a port on the housing of the fluid valve. Furthermore, a fluid chamber may have a greater precision than a mechanical mechanism (e.g., a spring) for opening and closing the fluid valve at a desired pressure. A fluid chamber can have a wider operating range than a spring-based system due to geometric constraints imposed by use of springs. During disassembly, a fluid chamber can be bled fully of its pressure to neutralize any residual force.

FIG. 1 illustrates an example well system 100 that includes a downhole fluid valve, such as a distributor valve 145. The well system 100 is provided for convenience of reference only, and it should be appreciated that the concepts herein are applicable to a number of different configurations of well systems. As shown, the well system 100 includes a downhole tool string 130 within a substantially cylindrical wellbore 115 that extends from a terranean surface 105 through one or more subterranean zones 110. The wellbore 115 can be an openhole wellbore, a cased wellbore, or a partially cased wellbore. FIG. 1, however, illustrates an implementation in an open hole (e.g., uncased) wellbore. Moreover, although illustrated as extending from the terranean surface 105, the wellbore 115 (and well system 100) can be constructed in an ocean-based environment or other environment that includes a body of water.

In FIG. 1, the wellbore 115 extends substantially vertically from the terranean surface 105. However, in other instances, the wellbore 115 can be of another position, for example, the wellbore 115 deviates horizontally in the subterranean zone, or entirely substantially vertical or slanted. The wellbore 115 may deviate in another manner than horizontal, such as multi-lateral, radiussed, slanted, directional, and/or may be of another position.

The illustrated example well system 100 includes an upper seal 120 and a lower seal 125. The upper seal 120 and lower seal 125 are coupled to the tool string 130 and are located in the annulus 140 between the tool string 130 and the sidewall of the wellbore 115. The seals 120, 125 isolate sections of the annulus 140. The seals 120, 125 can be any suitable sealing apparatus such as a packer. The tool string 130 includes the distributor valve 145 that is located between the seals 120, 125 and thus adjacent to a section of annulus 140 that is isolated (e.g., fluidly) from sections of the annulus 140 that are uphole and downhole of the seals 120 and 125, respectively.

Generally, the distributor valve 145 may regulate pressure between openhole (or even possibly cased) seals 120 and 125 (e.g., packers). Distributing the differential pressure load across two or more seals may be advantageous when testing weak or vertically fractured subterranean zones or geologic formations. For example, a high differential across any single seal (e.g., packer) may cause an annulus fluid to communicate around the seal through a vertical fracture. In addition, distribution of the pressure may also help keep the formation from crushing under excessively high hydrostatic loadings of a single seal (e.g., packer). Regulating the pressure between two seals may help prevent buildup of excessive pressure when the seals (e.g., packers) are set. Regulating the pressures can also be helpful if the performance of one or more packers has been compromised or is suspected to have been compromised.

In some implementations, the distributor valve 145 may operate to regulate pressure (e.g., annulus pressure) between the seals 120, 125 by opening and closing a conduit between the annulus 140 and the tool string 130. The distributor valve 145 includes a fluid chamber that contains a pressurized fluid. When the pressure at the location of the distributor valve 145 is greater than the pressure of the fluid in the fluid chamber, the distributor valve 145 opens. When the pressure at the location of the distributor valve 145 is less than the pressure of the fluid in the fluid chamber, the distributor valve 145 closes.

Figure 2A:
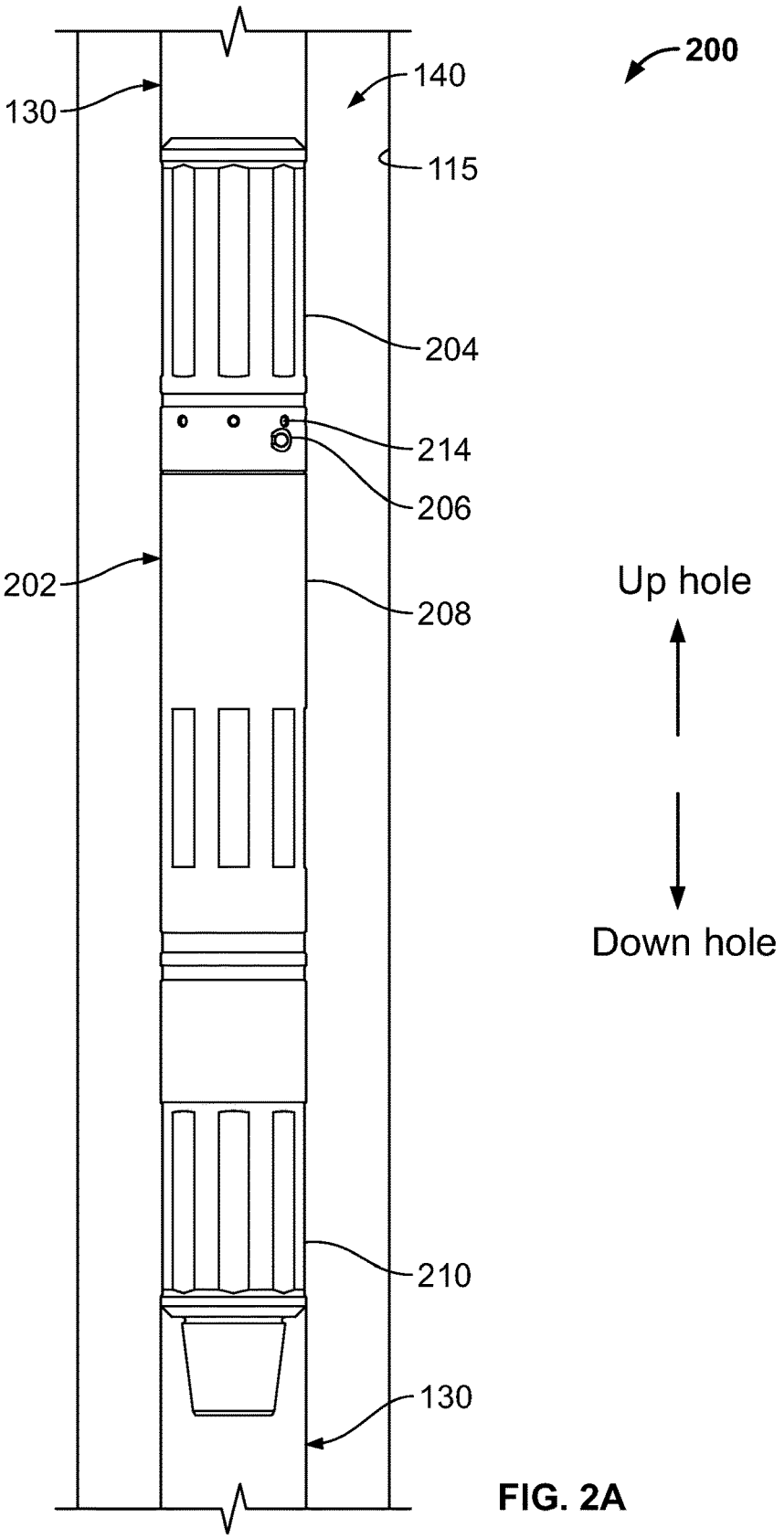
FIG. 2A illustrates an example implementation of a distributor valve.
Figure 2B:
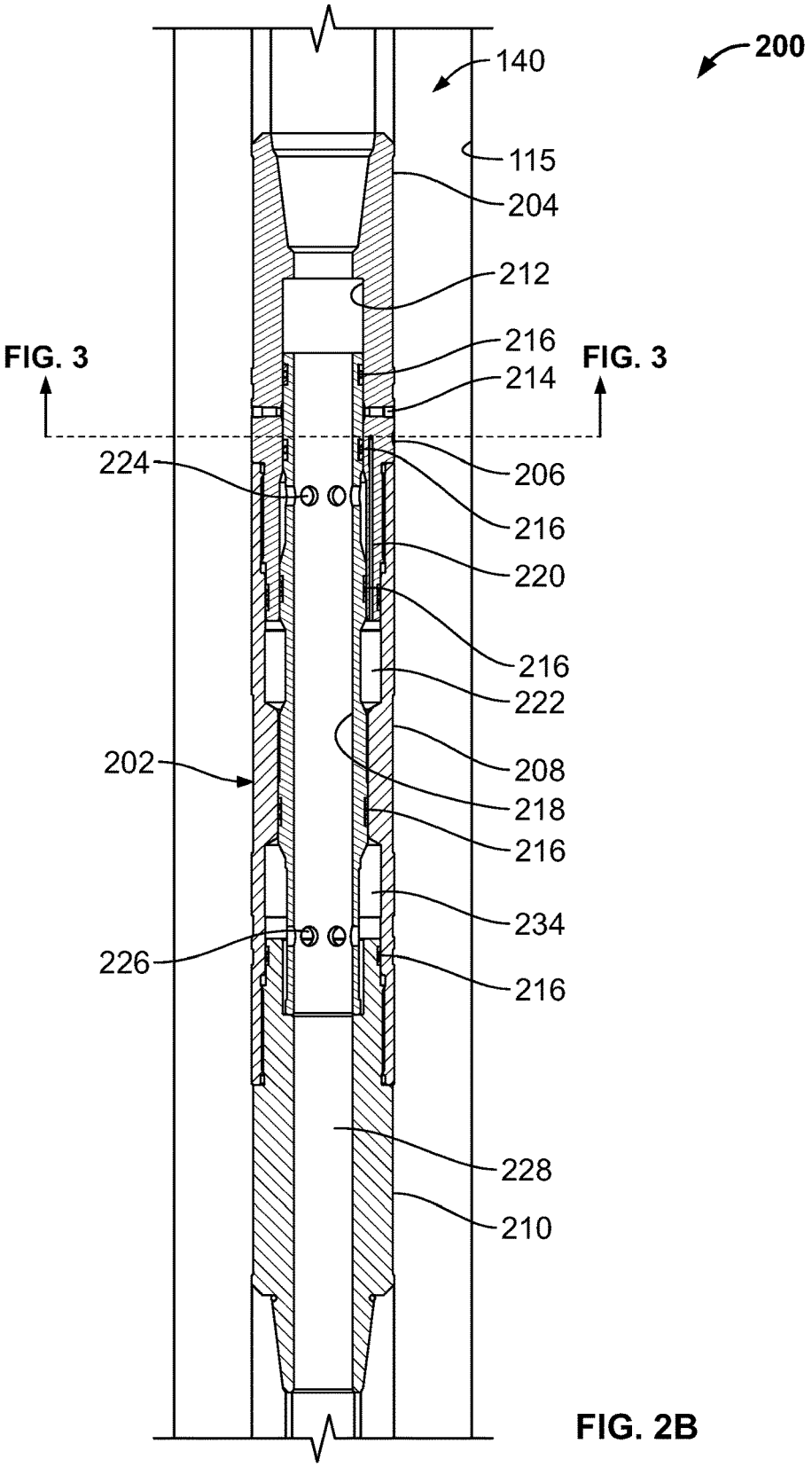
FIG. 2B illustrates a cross-sectional view of an example implementation of the distributor valve in a closed position.
Figure 2C:
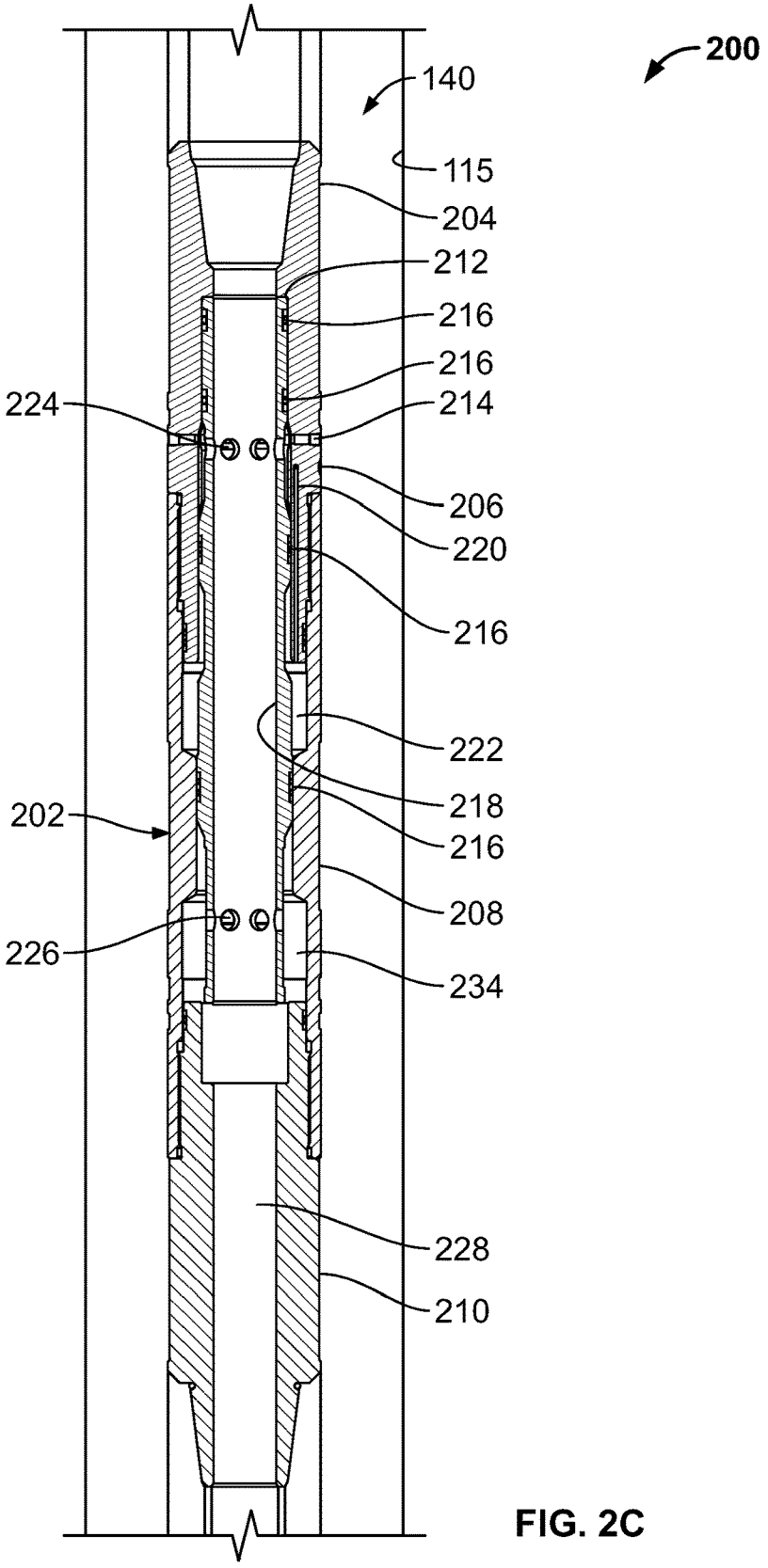
FIG. 2C illustrates a cross-sectional view of an example implementation of the distributor valve in an open position.

FIG. 2A-2C illustrate an example well system 200, including an example implementation of a distributor valve 202. The well system 200 is substantially similar to the well system 100 shown in FIG. 1, and the distributor valve 202 may be substantially similar to the distributor valve 145 shown in FIG. 1. The distributor valve 202 is included as part of tool string 130 that is located within the wellbore 115.

The illustrated distributor valve 202 includes a housing 208 coupled to a top adapter subassembly 204 and a bottom adapter subassembly 210. The housing 208 extends all or a portion of the length of the distributor valve 202. The top adapter subassembly 204 is attached (e.g., threadingly) to an uphole end of the housing 208. The top adapter subassembly 204 allows other tools, tubing, or other components (such as a packer tool) to be coupled to the uphole end of distributor valve 202. Likewise, the bottom adapter subassembly 210 is attached (e.g., threadingly) to a downhole end of the housing 208 to allow tools, tubing, or other components to couple to the downhole end of distributor valve 202.

In the illustrated implementation, the top subassembly 204 includes housing ports 214 that provide flow paths from an exterior of the distributor valve 202 (e.g., the annulus 140) through the top subassembly 204. In some implementations, the housing ports 214 are located on the housing 208 and provide flow paths from the exterior through the housing 208.

FIG. 2B illustrates a cross-sectional view of an example implementation of the distributor valve 202 in a closed position. FIG. 2C illustrates a cross-sectional view of an example implementation of the distributor valve 202 in an open position. The distributor valve 202 includes a through bore 208 that extends axially through the distributor valve 202. The through bore 208 allows fluid to be communicated through the tool string 130.

The distributor valve 202 includes a mandrel 218 surrounding and defining a portion of the through bore 228. The mandrel 218 is positioned radially within the housing 208. The mandrel 218 includes a set of upper mandrel ports 224 formed through the mandrel 218 that are positioned circumferentially around an upper portion of the mandrel 218. The mandrel 218 also includes a set of lower mandrel ports 226 formed through the mandrel 218 that are positioned circumferentially around a lower portion of the mandrel 218. The mandrel 218 is moveable between a first position (shown in FIG. 2B) with the through bore 228 fluidly decoupled from housing ports 214 and a second position (shown in FIG. 2C) with the through bore 228 fluidly coupled to housing ports 214 through upper mandrel ports 224.

A radial outer surface of the mandrel 218 and a radial inner surface of the housing 208 define a fluid chamber 222. As such, the fluid chamber 222 is radially located between the mandrel 218 and the housing 208. The fluid chamber 222 is configured to contain fluid at a particular pressure, and is fluidly isolated by an upper seal 216 positioned between the mandrel 218 and the housing 208 and a lower seal 216 positioned between the mandrel 218 and the housing 208. The fluid chamber 222 is fluidly connected to fill port 206 by fill conduit 220. Fill port 206 is a sealable port located at the exterior surface of the top subassembly 204. Through fill port 206, the fluid chamber 222 can be filled with a fluid or gas at a particular pressure. In some implementations, the fluid is nitrogen gas, but other pressurized fluids, such as compressible, non-flammable, gases are also contemplated by the present disclosure.

A lower chamber 234 is defined by the mandrel 218, the housing 208, and the bottom subassembly 210. The lower chamber 234 is fluidly connected to the through bore 228 by lower mandrel ports 226. The lower chamber 234 is fluidly isolated from the fluid chamber 222 and the annulus 140 by multiple seals 216.

As illustrated in FIG. 2B, a particular seal 216 is positioned between the mandrel 218 and the top subassembly 204 adjacent an uphole end of the pressure chamber 222, while another particular seal 216 is positioned between the mandrel 218 and the housing 208 adjacent a downhole end of the pressure chamber 222. In the illustrated implementation, these two seals 216 may be of different diameters so that, for example, the mandrel 218 may move to open the valve 202 (as shown in FIG. 2C) when a pressure in the bore 228 exceeds a pressure in the chamber 222.

In an example operation, the distributor valve 202 is lowered into the well 115 with the distributor valve 202 in the closed position as shown in FIG. 2B. The annulus 140 may not yet be isolated by seals 120, 125, so the hydrostatic pressure in the annulus 140 is approximately equal to the pressure in the through bore 228. The lower chamber 234 has a pressure approximately equal to the pressure in the through bore 228. The fluid chamber 222 has been pre-filled to a particular pressure prior to the distributor valve 202 being lowered into the well 115. Initially, the pressure in the fluid chamber 222 is greater than the pressure in the lower chamber 234 and the bore 228, and the differential area between fluid chamber 222 and lower chamber 234 impart a net force to maintain the mandrel 218 in the closed position (e.g., shouldered out against the lower sub-assembly 210).

As the distributor valve 202 is lowered into the well 115, the hydrostatic pressure in the well 115 at the location of the distributor valve 202 increases. Thus, the pressure in the annulus 140, the through bore 228, and the lower chamber 234 will increase. If the pressure in the lower chamber 234 increases beyond the particular pressure of the fluid in the fluid chamber 222, the net force on the mandrel 218 will shift the mandrel 218 upward into the open position (FIG. 2C), opening the distributor valve 202. The shoulder 212 limits the upward movement of the mandrel 218.

When in the open position, the upper mandrel ports 224 are aligned with the housing ports 214 so that the through bore 228 is fluidly coupled to the annulus 140. Once the lower seal 125 downhole of the distributor valve 202 is set, the only fluid communication between the annulus 140 and the through bore 228 happens through the distributor valve 202. The lower seal 125 and upper seal 120 are set (e.g., by compression), and the fluid between the seals 120, 125 will be squeezed as the upper seal 120 is setting. Thus, setting an upper seal 120 will further increase the fluid pressure in the annulus 140 and through bore 228.

The increase in fluid pressure due to seal setting can cause detrimental effects to both the reservoir and the seals 120, 125 themselves. The presence of an open distributor valve 202 in between the two seals 120, 125 gives the fluid an escape path so as to reduce or eliminate this pressure spike. In some implementations, the distributor valve 202 is closed prior to setting the upper seal 120, and the increase in fluid pressure from setting the upper seal 120 raises the pressure in the through bore 228 sufficiently to overcome the fluid chamber 222 pressure and open the distributor valve 202.

After the upper seal 120 and lower seal 125 are set, the tester valve 135 may be opened. Opening the tester valve 135 flows well fluid in the through bore 228. Once fluid flows in the through bore 228, the fluid pressure within the through bore 228 decreases. The annulus 140 also decreases, because the through bore 228 and the annulus 140 are fluidly coupled through the open distributor valve 202. Once the pressure in the through bore 228 has decreased sufficiently below the pressure within the fluid chamber 222, the higher pressure in the fluid chamber 222 moves the mandrel 218 down, misaligning the upper mandrel ports 224 and the housing ports 214. The distributor valve 202 is thus closed by fluidly decoupling the through bore 228 from the housing ports 214.

Before closing, the distributor valve 202 allows enough fluid to escape from the annulus 140 into the through bore 228 to reduce the between-the-seals annulus 140 pressure to the predetermined pressure of the fluid chamber 222. The pressure in the isolated section of the annulus 140 between the seals 120, 125 will thus have a lower pressure than the pressure in the section of the annulus 140 above the upper seal 120 and a higher pressure than the pressure in the section of the annulus 140 below the lower seal 125. Since the isolated section of the annulus 140 has an intermediate pressure, the differential pressure each seal 120, 125 has to seal against is reduced.

Figure 3:
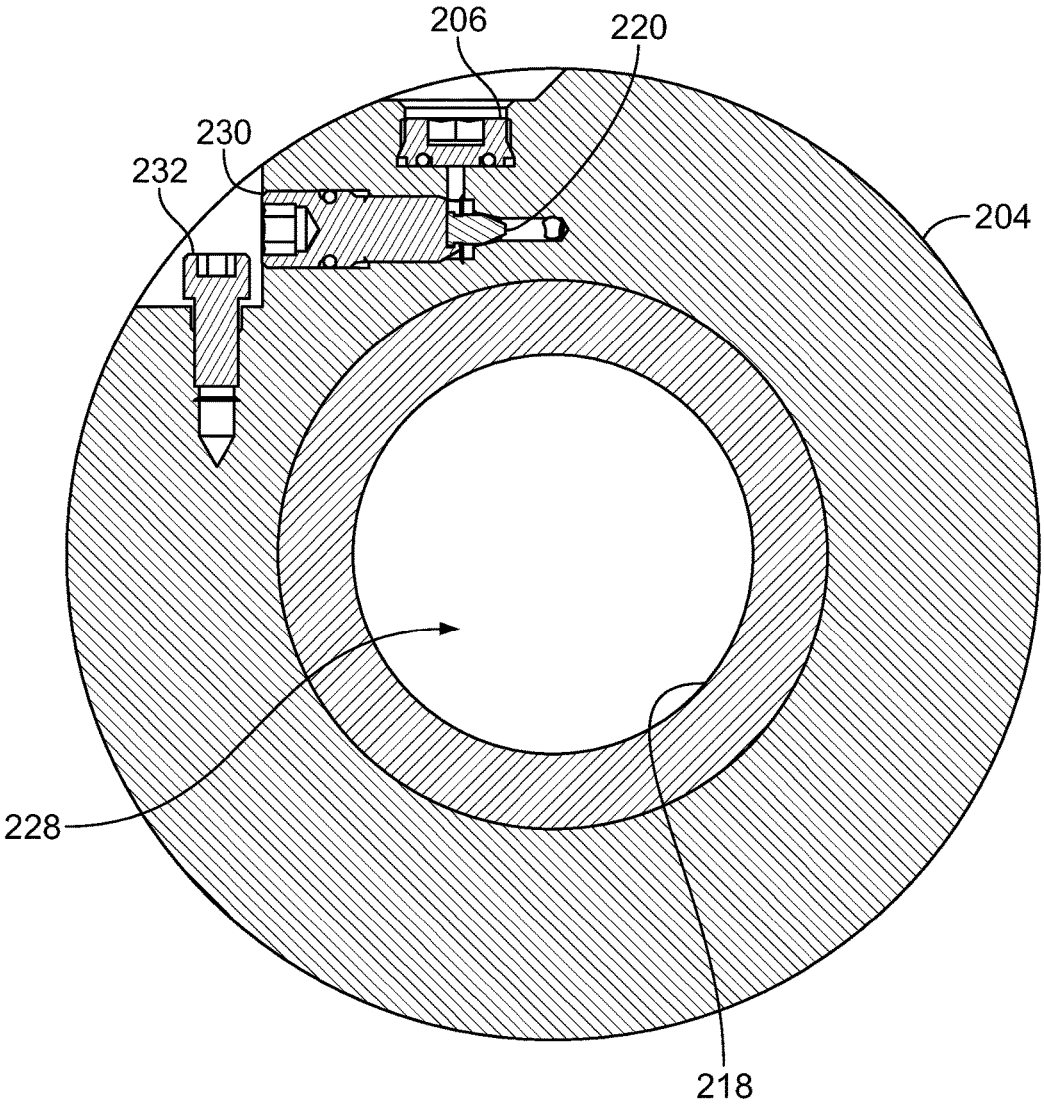
FIG. 3 illustrates a cross-sectional view of a portion of an example implementation of the distributor valve.

FIG. 3 illustrates a cross-sectional view (as indicated in FIG. 2B) of a portion of an example implementation of the distributor valve 202. FIG. 3 shows the fill port 206 on the outside surface of the top subassembly 204. The fill port 206 is fluidly coupled to the fluid chamber 222 via fluid conduit 220. The fill cap 230 seals the fill port 206 to isolate the fluid chamber 222 from the exterior of the distributor valve 202. The fill cap 230 is secured by set screw 232. In some implementations, the fill port 206 is located on the outside surface of the housing 208 or the bottom subassembly 210. The fluid chamber 222 can be filled with a fluid or a gas through fill port 206. For example, the fluid chamber 222 can be filled with nitrogen, air, carbon dioxide, or another gas or fluid. The fluid chamber 222 is filled with fluid prior to moving the distributor valve 202 into the wellbore 115. The fluid chamber 222 can be filled with fluid at a particular pressure to set the hydrostatic pressure at which the distributor valve 202 opens. The particular pressure within the fluid chamber 222 can be determined based on estimated or calculated downhole conditions. For example, the particular pressure can be based, at least in part, on the difference between the estimated downhole temperature, pressure, or chamber volume and the estimated surface temperature, pressure, or chamber volume. This particular pressure can also be based on the difference between the volume of the fluid chamber when the tool is fully closed and when it is beginning to open.

A number of implementations have been described. Nevertheless, it will be understood that various modifications may be made. For example, example operations, methods, and/or processes described herein may include more steps or fewer steps than those described. Further, the steps in such example operations, methods, and/or processes may be performed in different successions than that described or illustrated in the figures. Accordingly, other implementations are within the scope of the following claims.

What is claimed is:

1. A downhole distributor valve, comprising:

a housing that comprises a housing fluid port therethrough;

a mandrel that defines a bore and is positioned radially within the housing, the mandrel comprising a mandrel fluid port therethrough;

a fluid chamber radially defined between the housing and the mandrel and configured to contain a fluid at a particular pressure, the mandrel moveable from a first position with the bore fluidly decoupled from the housing fluid port to a second position with the bore fluidly coupled with the housing fluid port through the mandrel fluid port based on a hydrostatic pressure in the bore greater than the particular pressure of the pressurized fluid, wherein the particular pressure is based, at least in part, on a difference in an estimated downhole temperature and an estimated surface temperature.

2. The downhole distributor valve of claim 1, wherein the fluid chamber comprises a gas chamber, and the fluid at the particular pressure comprises a gas at the particular pressure.

3. The downhole distributor valve of claim 2, wherein the gas comprises nitrogen.

4. The downhole distributor valve of claim 1, further comprising a fluid fill port at the exterior surface of the housing that is fluidly coupled to the fluid chamber.

5. The downhole distributor valve of claim 1, wherein the mandrel is moveable from the second position with the bore fluidly coupled with the housing fluid port through the mandrel fluid port to the first position with the bore fluidly decoupled from the housing fluid port based on the hydrostatic pressure in the bore less than the particular pressure of the fluid in the fluid chamber.

6. The downhole distributor valve of claim 1, wherein the mandrel comprises a radial outer surface between an upper seal positioned between the mandrel and the housing and a lower seal positioned between the mandrel and the housing, the radial surface comprising an effective force area between the pressurized fluid and the hydrostatic pressure.

7. A method, comprising:

moving a distributor valve at a closed position into a wellbore, the distributor valve comprising a housing that comprises a housing fluid port, a mandrel that defines a bore and is positioned radially within the housing, and a fluid chamber radially defined between the housing and the mandrel;

moving the distributor valve toward a downhole location in the wellbore at the closed position, the bore fluidly decoupled from the housing fluid port at the closed position;

determining a particular pressure of the fluid chamber based at least in part on a difference in an estimated temperature in the wellbore at the downhole location and an estimated surface temperature; and based on a hydrostatic pressure in the bore that is greater than the particular pressure of a fluid contained in the fluid chamber, adjusting the distributor valve to an open position by urging the mandrel, with the hydrostatic pressure, to fluidly couple the bore to the annulus through a mandrel fluid port and the housing fluid port.

8. The method of claim 7, further comprising charging the fluid chamber with an amount of the fluid to the particular pressure prior to moving the distributor valve into the wellbore.

9. The method of claim 8, wherein the fluid comprises nitrogen gas.

10. The method of claim 7, wherein the downhole location in the wellbore is uphole of a first seal that fluidly decouples a portion of the annulus downhole of the first seal from a portion of the annulus uphole of the first seal, the method further comprising:

locating a second seal uphole of the downhole location; and setting the second seal to fluidly decouple a portion of the annulus uphole of the second seal from a portion of the annulus between the first and second seals.

11. The method of claim 10, further comprising adjusting the distributor valve to the open position based on setting the second seal.

12. The method of claim 7, further comprising:

opening a tester valve in fluid communication with the distributor valve in a downhole work string, the tester valve positioned uphole of the distributor valve in the downhole work string;

and flowing a wellbore fluid through the bore and toward a terranean surface based on opening the tester valve.

13. The method of claim 12, further comprising:

based on opening the tester valve, adjusting the distributor valve to the closed position by urging the mandrel, with the pressurized fluid contained in the fluid chamber, to fluidly decouple the bore from the annulus.

14. The method of claim 13, further comprising misaligning the mandrel fluid port and the housing fluid port to fluidly decouple the bore from the annulus.

15. A downhole valve, comprising:

an outer case that comprises a flow path port therethrough;

a mandrel that defines a bore and is positioned radially within the case, the mandrel comprising a fluid port therethrough;

a pressurized gas chamber that encloses an amount of gas at a predetermined pressure, the pressurized gas chamber defined between the outer case and the mandrel, the mandrel moveable from a closed position with the bore fluidly decoupled from the flow path to an open position with the bore fluidly coupled with the flow path through the fluid port based on a hydrostatic pressure in the bore greater than the predetermined pressure of the gas, wherein the predetermined pressure is determined based, at least in part, on at least one of a downhole temperature or a characteristic of a subterranean zone.

16. The downhole valve of claim 15, wherein the mandrel is moveable from the open position with the bore fluidly coupled with the flow path through the fluid port to the closed position with the bore fluidly decoupled from the flow path based on the hydrostatic pressure in the bore less than the predetermined pressure of the gas.

17. The downhole valve of claim 15, wherein the pressurized gas chamber comprises a self-contained chamber that is fluidly decoupled from the exterior during operation of the valve.

* * * * *